US005545114A

United States Patent [19]

Gvoich

[11] Patent Number: 5,545,114

[45] Date of Patent: Aug. 13, 1996

[54] ABDOMINAL EXERCISE DEVICE

[75] Inventor: Ned Gvoich, Beamsville, Canada

[73] Assignee: Kor-One, Ltd., Tempe, Ariz.

[21] Appl. No.: 428,027

[22] Filed: Apr. 25, 1995

[51] Int. Cl.[6] ..... A63B 23/02

[52] U.S. Cl. ..... 482/140; 482/142; 482/123

[58] Field of Search ..... D21/191–196; 482/142, 130, 140, 141, 148, 123

[56] References Cited

U.S. PATENT DOCUMENTS

| | | | |
|---|---|---|---|
| 1,950,174 | 3/1934 | Harrison | 482/130 |
| 3,005,633 | 10/1961 | Riemer | 482/142 |
| 3,782,717 | 1/1974 | Berlin | 482/142 |
| 5,100,130 | 3/1992 | Shoebrooks | 482/140 |
| 5,100,131 | 3/1992 | Fong | 482/112 |
| 5,110,122 | 5/1992 | Moore et al. | 482/134 |
| 5,122,107 | 6/1992 | Gardner | 482/140 |
| 5,232,425 | 8/1993 | Miller | 482/121 |
| 5,256,126 | 10/1993 | Grotstein | 482/142 |
| 5,300,005 | 4/1994 | Wang | 482/142 |
| 5,308,306 | 5/1994 | Wang | 482/142 |
| 5,346,447 | 9/1994 | Stearns | 482/96 |
| 5,498,222 | 3/1996 | Hur | 482/142 |

*Primary Examiner*—Stephen R. Crow
*Assistant Examiner*—Jerome Donnelly
*Attorney, Agent, or Firm*—O'Connor Cavanagh

[57] ABSTRACT

An exercise device for exercising all of the major muscles comprising the upper and lower abdomen and back, while avoiding undue stress on the lumbar and cervical spinal discs and the muscles comprising the lower back and hip flexors. The device provides rigid upper and lower back supports which are pivotally joined at a point which restricts flexure of the spine to the T10-L1 region. Resistance means attach to the pivotal portions of the device to allow adjustable resistance to exercise motions.

12 Claims, 7 Drawing Sheets

ABDOMINAL EXERCISE DEVICE

BACKGROUND OF THE INVENTION

This invention relates to an exercise device for exercising all of the major muscles comprising the upper and lower abdomen and back, while avoiding undue stress on the lumbar and cervical spinal discs and the muscles comprising the lower back and hip flexors.

It is well-known in the fitness industry that exercises which can optimally strengthen and tone the principal muscles in the abdominal region preferably are specific to particular muscles and/or to portions of those muscles.

The principal abdominal muscles include the rectus abdominus. The rectus abdominus muscles are a pair of long flat muscles, on either side of the navel, which extend along the whole length of the front of the abdomen from the lower rib cage to the front of the iliac and pubic bones of the pelvis. The rectus abdominus muscles are interconnected by the linea alba, a band of fibrous connective tissue.

The principle muscles in the back include the erector spinae muscle which is composed of the iliocostalis, longissimus and spinalis muscles. These three muscles are grouped into a pair of long thick muscles running on either side of the spine for the length of the back.

The upper portion of the rectus abdominus can be effectively exercised by performing repetitions of "sit-ups" using the "crunch" technique. In this context, "crunch" refers to the motion in which the trunk of the human body is raised from a supine position, i.e., flexed, in a curling motion, while the spine is flexed so that the anterior portion of the spine is concave while the posterior portion of the spine is convex, and with the legs remaining straight or bent.

The lower portion of the rectus abdominus can be effectively exercised by performing repetitions of the "knee-up" exercise in which the knees are lifted in an arcing motion toward the chest wall. "Knee-up" exercise refers to that motion of rotation of the legs, with the knees facing up and bent, and while the person is lying on the ground or floor.

The muscles of the back can be effectively exercised by performing a "reverse-situp," where the individual is supported above the ground in a fashion to allow the body to bend at the waist with the head hanging down. The individual then raises the head and body to an erect (albeit horizontal) position.

A primary concern during abdominal and back exercises is the motion of the vertebrae of the spinal column. The spine is made up of 33 vertebrae which form a column. The vertebrae are conventionally divided into three regions: the cervical (upper back and neck); thoracic (mid-back, contiguous with the rib cage); and, the lumbar (the lower back). Each region of the spine is responsible for implementing specific motions of the body. For instance, the cervical region provides a full range of rotation, whereas the thoracic region has limited rotation and lumbar region has restricted rotation. The entire spine can be flexed forward through "rocking", i.e., bending the entire spine, or "crunching" i.e., hingelike movement focused at the T10-L1 region of the spine.

Problems with the spine arise when regions of the spine are subjected to stresses or motions that are inconsistent with the function of that region. For instance, excessive rotation of the lumbar region vertebrae can cause damage to the intervertebral discs. Similarly, excessive lateral loading of .the cervical region can cause injury to discs. Improper movements can also overstress and fatigue related muscle groups.

When exercising the muscles of the abdomen and back, a primary source of concern is the safeguarding of the lumbar region of the spine. The lumbar spine movements are predicated predominately by the orientation of the facet joints. The facet joints on the lumbar vertebrae are flattened and essentially vertical "plates" on the sides of the vertebrae which interlock to restrict vertebral rotation. The primary movement in the lumbar spine is therefore flexion and extension with rotation limited when the facets are engaged. However, as the front flexes forward, the facets are disengaged in the mid-range of flexion thereby permitting slight vertebral rotation. As the trunk flexes past the mid-range of trunk flexion, the facet joints are once again engaged thereby restricting the extent of vertebral rotation. In addition, when the intervertebral joints are subjected to the stress of weight-bearing or of motion, small movements of the joints, known as "strain deflections" result.

As emphasized in *H. F. Farfan, Mechanical Disorders of the Lower Back*, Lea & Febizer (1973), it is "generally conceded that it is virtually impossible to have a pure movement in any of the three principal planes [i.e., bending, twisting, leaning]. The orientation of the facet surfaces generally does not coincide with the plane of the motion and therefore modifies the motion of the intervertebral joint. This is more certainly true of rotation than it is for flexion or extension. In an individual with symmetrical vertebrae, movements in the A-P plane may be free of either lateral bend or rotation. However, rotation is not possible without some degree of flexion and lateral bend." Thus, with reference to Farfan, it may be seen that the "crunch" motion, even in an individual with a symmetric spine, defines a complex curve or arc for a given joint as the spine is flexed through its entire range of motion. Consequently, as flexure occurs in the lower lumbar region, vertebral rotation and strain deflections occur which cause stress to lumbar spinal discs.

Therefore, when performing abdominal or back exercises it is desirable to minimize or eliminate flexure or extension in the lower lumbar region. This can be accomplished by restricting flexure of the spine to the T10-L1 region of the spine by performing a proper crunch motion and avoiding a rocking motion. Because the T10-L1 region is the "hinge" portion of the spine it is less likely to suffer rotation or strain deflections during flexure.

Performance of "crunches" or situps can have equally deleterious effects on the cervical region of the spine. Unless the head is supported during these exercises, the lateral stresses on the head and neck i.e., the hanging of the head will rapidly fatigue the muscles supporting the head. The result of the muscle fatigue is additional stress on the vertebrae and intervertebral discs.

In sum, as conventionally performed, i.e., free hand, abdominal and back exercises are not without hazard and inconvenience. Performing free hand sit-ups while keeping the legs straight risks injury and pain due to undue stress on the lower back regions. There is also danger of straining the hip flexor muscles and difficulty of controlling or adjusting muscular resistance. Performing free hand knee-ups also risks injury to the lower back and hips. Unless the knees are kept bent, the back is always curved and the abdominal muscles are tensed, thereby increasing the stress to the lower spine. Also, both free hand sit-ups and most exercise devices tend to create the undesirable rocking motion rather than the desirable hingelike or curling flexure of the back associated with a proper "crunch". The increased radius of flexure associated with rocking creates excessive movement in the lower lumbar region-of the spine allowing undesirable strain deflection and rotation. Furthermore, at the upper portion of the movement associated with a "crunch," the head tends to hang down, which can cause fatigue or discomfort in the neck.

There are few free hand exercises comparable to sit-ups or crunches which exercise the muscles in the back. Thus, individuals tend to over-exercise the abdominal muscles and under-exercise the back muscles, which can lead to discomfort and fatigue as a result of imbalanced musculature. As with situps and kneeups, the conventional reverse situps generate excessive flexure of the back creating a potential for injury. The free hand reverse sit-up is uncomfortable as it generally involves a support placed under the abdomen resulting in excessive pressure to the gut. Also, the inverted position of the body and head, can result in discomfort and dizziness. As in the free hand crunch or sit-up, the neck is without support, resulting in fatigue and discomfort in the neck as well as a potential for injury to the cervical discs.

Therefore, to minimize the risk of injury as well as achieve a greater level of comfort and control compared to that resulting from performing free hand abdominal and back exercises, there has been a need for a device and/or technique whereby a person can perform the crunch motion while performing repetitions of exercises equivalent to sit-ups, reverse sit-ups and/or knee-ups, but while remaining within safe limits of stress to the neck, back and abdominal muscles.

Various resistance-type exercise devices for exercising abdominal muscles are known. However, it has been found that when a person undertakes a program of conditioning the abdominal or back muscles by systematic use of such a device, that person often soon abandons the program because the resistance is so great as to allow performing only a few repetitions before fatigue sets in, or so small that the muscles are not adequately stressed regardless of how many repetitions are done. Even if the resistance is initially in an appropriate range for a user's muscular strength, he or she may find that as his or her muscles become stronger through exercise, that a conditioning plateau is reached where the set resistance is insufficient to provide further strengthening, thereby necessitating a need for a means to progressively increase or vary the resistance.

As is well-known, the preferred method for strengthening muscles is exercise using progressively increasing resistance because this places increasing demand on muscles and prevents them from accommodating to a specific force. Thus, to enable a resistance-type device to be used effectively by people having different strength, and to enable an individual who progresses through an exercise program to remain challenged as his or her strength increases, there is also a need for an abdominal and back exercise device which not only meets the above-stated criteria, but also one in which resistance can be conveniently increased or decreased.

Also, the general practice is to use a different device to exercise each targeted muscle group. This increases the complexity and cost of the exercise facility because of the multitude of different devices required to achieve a complete coverage of exercises. Thus, it is desirable to provide a single exercise device that can provide more than one exercise function, targeting more than one muscle group.

Devices for exercising the abdominal muscles are known. For example, U.S. Pat. No. 5,122,107 to Gardner describes a device which provides support to the head and neck of an individual performing sit-ups. U.S. Pat. Nos. 5,308,306 and 5,300,005 to Wang describe devices to provide assistance to an individual performing sit-ups. U.S. Pat. No. 5,256,126 to Grotstein describes a device to exercise muscles of the abdomen and back. U.S. Pat. No. 5,346,447 to Stearns describes devices for performing a multitude of exercises using the users weight for resistance.

Each of the above described devices address individual problems associated with performance of crunch motion exercises. As noted above, however, there are numerous problems which exist in conjunction. In order to provide effective and safe exercise these problems must be addressed in conjunction. Furthermore, the described devices generally involve large, complex and expensive machinery targeted at only one mode of exercise.

OBJECTS OF THE INVENTION

Accordingly, it is an object of the present invention to provide a device for exercising the abdominal and back muscles without over-stressing the muscles of the lower back and the hip flexor muscles.

Yet another object of the invention is to provide a device which facilitates performing repetitions of exercises equivalent to sit-ups, knee-ups and/or reverse sit-ups using the crunch conformation.

Another object of the invention is to provide a device which permits the upper body to move forward under stress, in an arc configuration so as to enable a user to easily assume and maintain the proper crunch motion during exercise, thus focusing the flexure of the spine at the T10-L1 region and eliminating undesirable flexure elsewhere.

A further object of the invention is to provide a means to perform the crunch motion and/or reverse a crunch motion without the discomfort or fatigue normally associated with the free hand method.

A further object of the invention is to provide a single device which enables performing crunch-type exercises for the upper body over a full range of motion.

Another object of the invention is to provide adequate support to the head and neck during exercise to avoid stress to the muscles of the neck and the cervical discs.

Another object of the invention is to provide an abdominal device whose resistance can be easily adjusted so as to accommodate users of different strength, and also provide a means of progressive resistance exercise for any individual users.

A further object of the invention is to provide a device which is light-weight and compact so as to be portable.

On more object of the invention is to provide a system that is relatively simple and inexpensive to manufacture, yet reliable.

Another object of the invention is to provide a device which enhances stability and aids in coordination of the crunch and reverse crunch movements.

Another object of the invention is to provide a single device to provide exercises for muscles of both the abdomen and the back.

Other objects of the invention will become evident when the following description of this invention is considered with the accompanying drawings.

SUMMARY OF THE INVENTION

The present invention overcomes inadequacies of conventional abdominal and back exercising techniques and devices by providing a single adjustable, light-weight, compact and easy to use resistance type device for exercising both the abdominal and back muscles, which enables a user to easily assume and maintain the crunch motion during an exercise routine.

Accordingly, an embodiment of the present invention includes a rigid frame on to which is mounted a lower back support. An upper back support is attached to the lower back support by means of a hinge. Attached to the sides of the upper back support are two leverage arms positioned such that when the user is laying on the back supports, the user may comfortably reach up and grasp the free ends of the leverage arms. In addition, the location of the pivotal attachment between the upper and lower back supports is positioned so as to coincide with the T10-L1 region of the user's spine. Attached to the rigid frame opposite the upper back support is a foot restraint which allows the user's feet to rest above the plane of the back, thus placing the knees in a bent position. The foot support is attached by a pivot to the rigid frame which allows the feet and knees to pivot into the crunch position, however, the pivoting action can be disabled.

To use the device, the user lays onto the back supports, grasps the handles of the leverage arms and places his or her feet in the foot restraint. The user then performs the crunching motion by bringing his or her head up and pulling the upper back support up underneath them. If the foot restraint is in the locked position the knees remain immobile and in a bent position. If the foot restraint is in its free and mobile configuration, the user may also draw the knees towards the head as the head is brought forward in the crunch motion. The user may also attach elastic or other resilient members between the rigid frame and the upper back support and the rigid frame and the foot restraints to increase the level of effort required to perform the crunching motion.

For performing back exercises a resilient member may be attached between the free ends of the leverage arms and the foot restraint drawing the device into the "crunched" position. Thus, the user would mount the device and perform a reverse crunch motion by pushing the upper back support down to the floor against the resistance of the elastic member.

Other means for applying resistance may be used. For instance, the pivot joint connecting the upper back support to the rigid frame may incorporate an isotonic device, providing resistance to both upward and downward motion. Also, the foot restraint may be mechanically connected to the lower back support so that resistance is provided by the user's weight.

BRIEF DESCRIPTION OF THE DRAWINGS

The above and other objects, aspects, features and attendant advantages of the present invention will become apparent from a consideration of the ensuing detailed description of presently preferred embodiments and methods thereof, taken in conjunction with the accompanying drawings, in which.

PREFERRED EMBODIMENTS

First Preferred Embodiment

Figure 1:
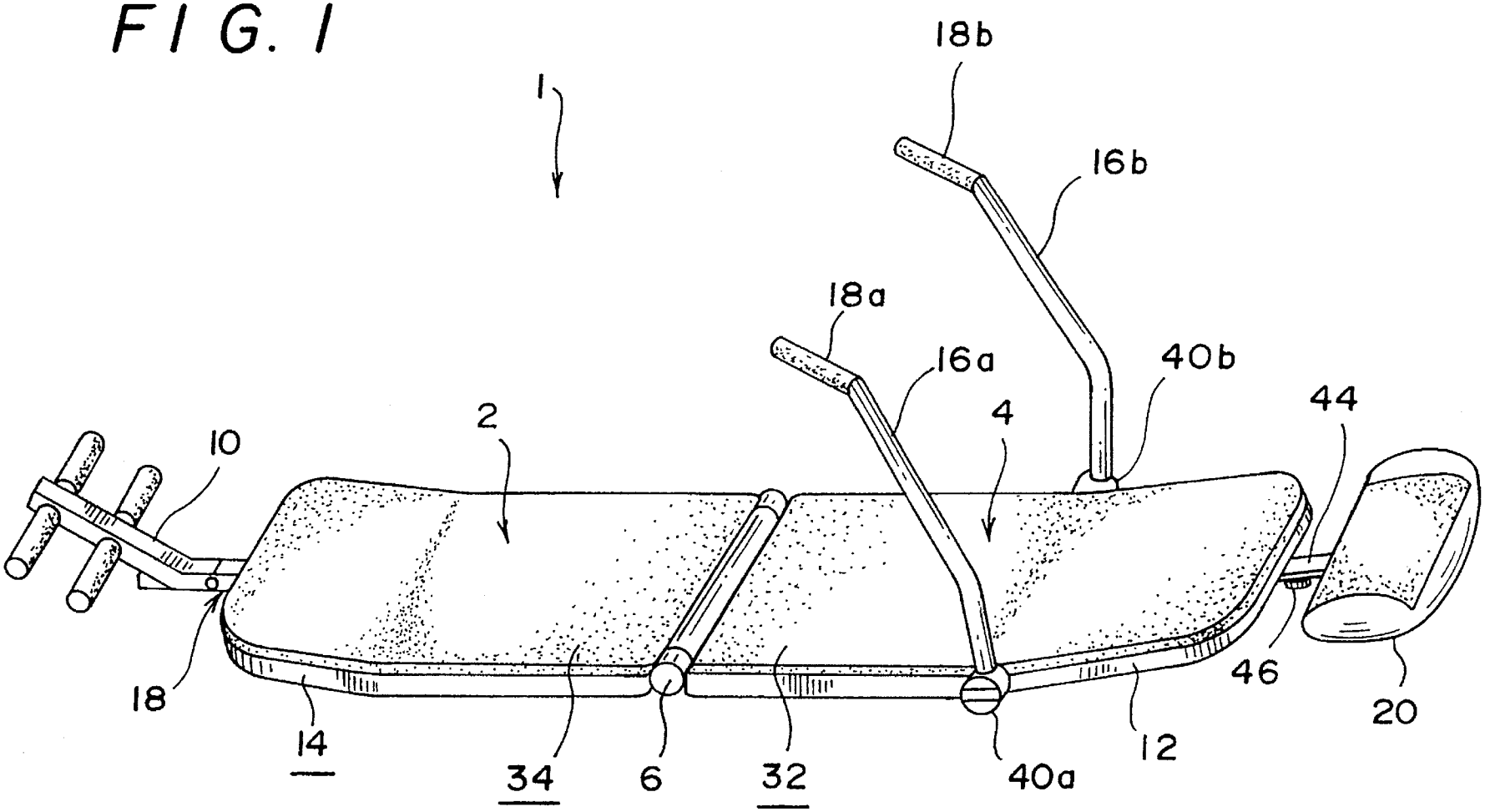
FIG. 1 is a perspective view of a first preferred embodiment.

Referring to FIG. 1, an abdominal and back exercise device 1 includes a lower back support 2 and an upper back support 4 joined by a pivotal means 6 which may be made up of a hinge, or other conventional pivotal attachment. The lower back support 2 is attached to a rigid frame 8 which is pivotally attached to a foot restraint 10. The head end 12 of the upper back support 4 and the foot end 14 of the lower back support 2 may be flat or canted in an upward direction to provide a cradling function to restrain the body of the user.

Figure 4:
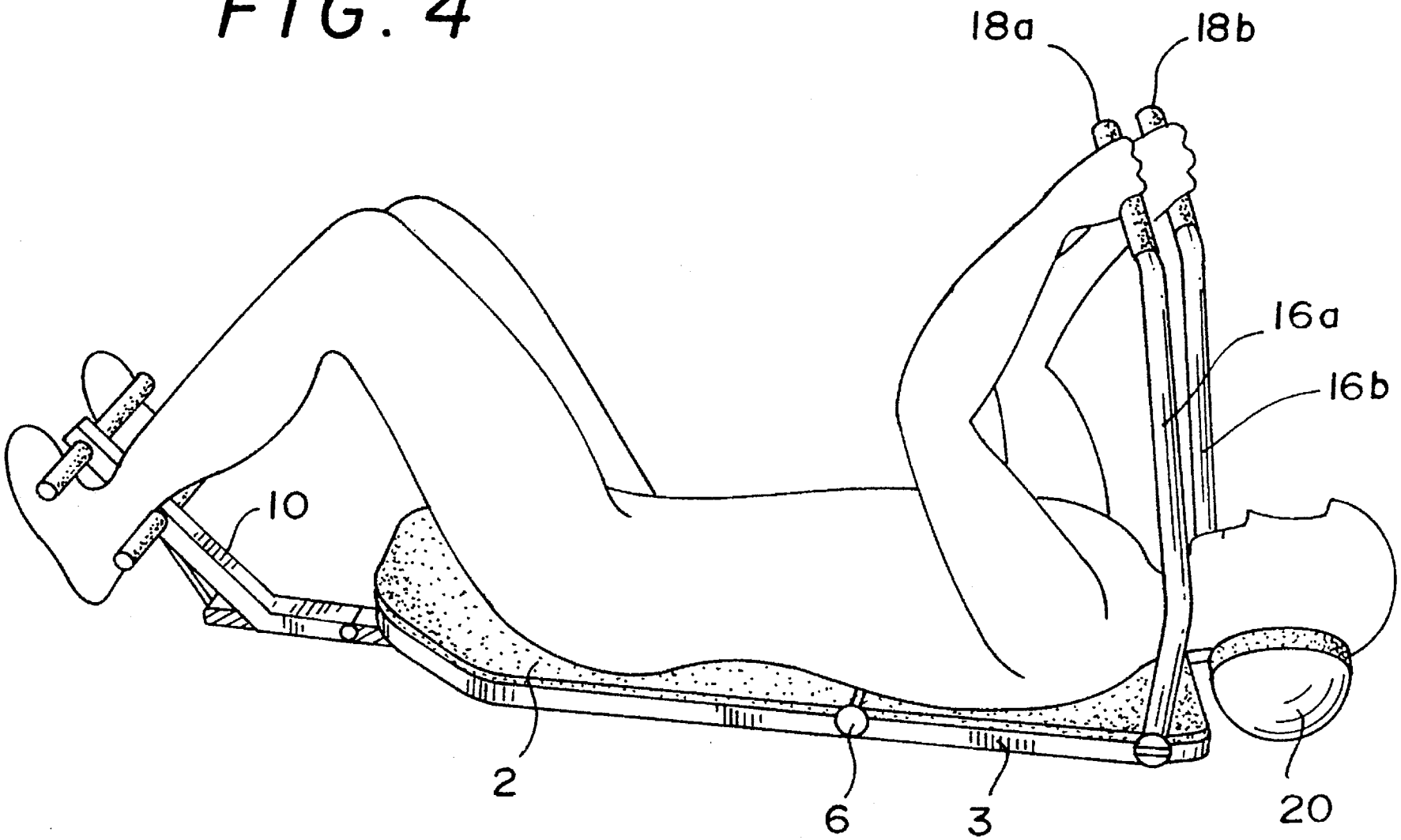
FIG. 4 illustrates the abdominal exercise mode of operational use of the first preferred embodiment, wherein a user lays on the device with the feet placed in foot restraints and with the hands grasping the handles.

As shown in FIG. 4, The arrangement of the elements is such that when a person lays with the lower portion of their back on the lower back support 2, the position of the pivotal attachment 6 is located at the T10-L1 region of the spine. The upper back rests on the upper back support 4 and the feet are placed in the foot restraint 10. Attached to the upper back support are two leverage arms **16*a* and 16*b* which are positioned so that when the user is lying in the device he or she may reach up and grasp the leverage arms by handles provided 18*a* and 18*b*. Furthermore, the upper back support may either extend sufficiently to support the head and neck or include a separate head and neck support 20**.

Figure 2:
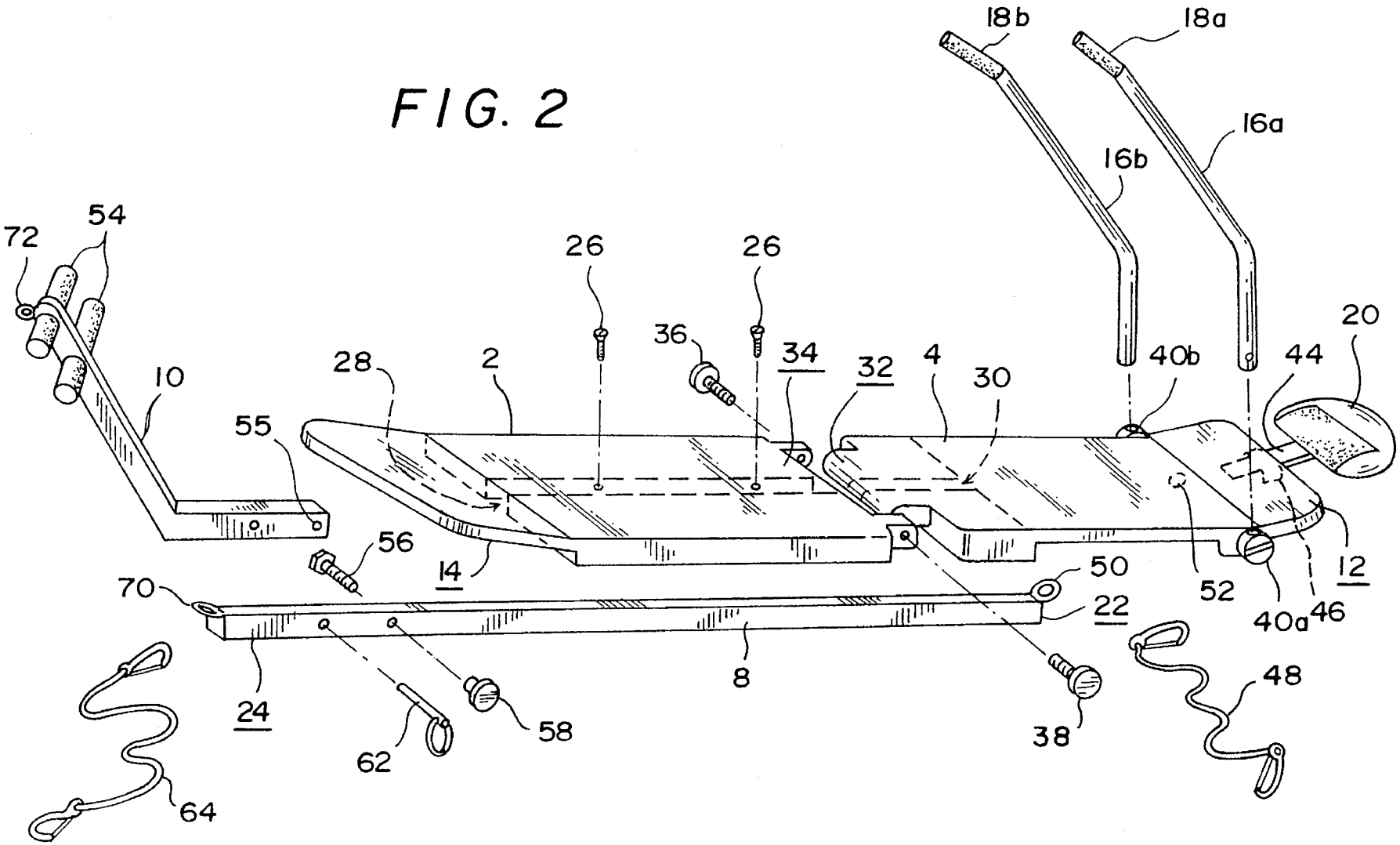
FIG. 2 is an exploded view of the first preferred embodiment.

Referring to FIG. 2, there may be seen rigid frame 8 which may be constructed of generally square or round cross-section hollow tubing. The rigid frame 8 is also preferably fabricated from a rigid material such as iron, although virtually any other rigid material, such as plastic, wood or aluminum may be used. Head end 22 of rigid frame 8 is oriented in the direction of the user's head. Foot end 24 of rigid frame 8 is oriented in the direction of the user's feet. The rigid frame is attached to the lower back support 2 and the foot restraint 10 as discussed more fully below.

Attached intermedially to the rigid frame 8 is the lower back support 2 by an attaching means such as a plurality of screws 26 or other conventional means. The lower back support 2 is a broad planar surface which may be cushioned for comfort and is appropriately sized to accommodate a full range of users. Rigid frame 8 extends beyond either end of the lower back support 2. The lower back support 2 is also preferably mounted on the rigid frame 8 so that the rigid frame 8 fits into a slot 28 on the bottom of the loser back support 2. This allows the device 1 to lie flat on the floor and thus enhances stability. Stability may alternatively be enhanced by providing additional support members to each side of the rigid frame 8, increasing frame width, using a space frame, or other conventional expedients.

Upper back support 4 is a broad planar surface which may be cushioned for comfort and is sized appropriately to accommodate a full range of users. The upper back support 4 also includes a rigid frame accommodation slot 30 for the same reasons noted above. The foot end 32 of upper back support 4 is attached to the head end 34 of the lower back support 2 by means of a hinge or other conventional pivot. For instance, as illustrated, the foot end of the upper back support 32 can be nested in the head end of lower back support 34 and pivotal action provided by inserting pins 36 and 38 through the lower back support 2 and into the upper back support 4.

Referring again to FIG. 1, the pivot means 6 is located to coincide with the T10-L1 region of the user's spine. This restricts flexure of the back to that region, ensuring a proper crunch motion. Leverage arms 16*a* and 16*b* are affixed to the upper back rest 4 by means of locking pivots 40*a* and 40*b*. The locking pivots 40*a* and 40*b* allow the position of the handles to be adjusted to conform to the user's needs.

Referring again to FIG. 3, attached at the head end 12 of the upper back support 4 is a head and neck support 20 which is attached by means of a sliding plate 44. The distance of said rest 20 from the upper back rest 4 may be adjusted by sliding the plate 44 and locking the plate by means of a locking knob 46. Optionally the head and neck support may be integral with the upper back support 4.

The upper back support 4 is attached to the lower back support 2 such that it rests over the head end 22 of rigid frame 8. An elastic means 48 may be connected between the head end 22 of rigid frame 8 and the sides or, preferably, the lower surface of the upper back support 4 by means of detachable connections 50 and 52. The elastic means may consist of a rubber band, an elastomer, a spring, or any other conventional form of resistance device.

The purpose of the elastic means 48 is to provide additional resistance so that when the upper back support 4 is drawn up into the crunch position (as indicated by the broken lines 53) the elastic means 48 pulls in a downward direction adding resistance to the movement of the user. The device may be provided with a multiplicity of such elastic means 48, each having a different resistance rate, thus allowing the user to alter the resistance provided by the device 1 by exchanging the elastic means 48. As an alternative means of providing resistance to the motion of the upper back support, the pivot means 6 may include an isotonic resistance device to provide exercise resistance as is more fully described in an alternative configuration shown in the second preferred embodiment.

Referring again to FIG. 2, a foot restraint 10 is attached intermedially to the rigid frame 8 proximate to the foot end 14 of the lower back support 2 by means of pivot 55. The foot restraint 10 may consist of a rigid frame with a plurality of perpendicularly protruding preferably padded cylinders 54 or may also consist of a platform whereby the feet are attached by straps, or may be other conventional forms of foot restraints. The foot restraint 10 is attached by means pin 56 and nut 58 so that a rotatable connection is formed, said attachment may also be made up of hinges or other conventional pivots. The pivot 55 may also be implemented with an isotonic resistance device to provide resistance to the movement of the foot restraint.

Figure 3:
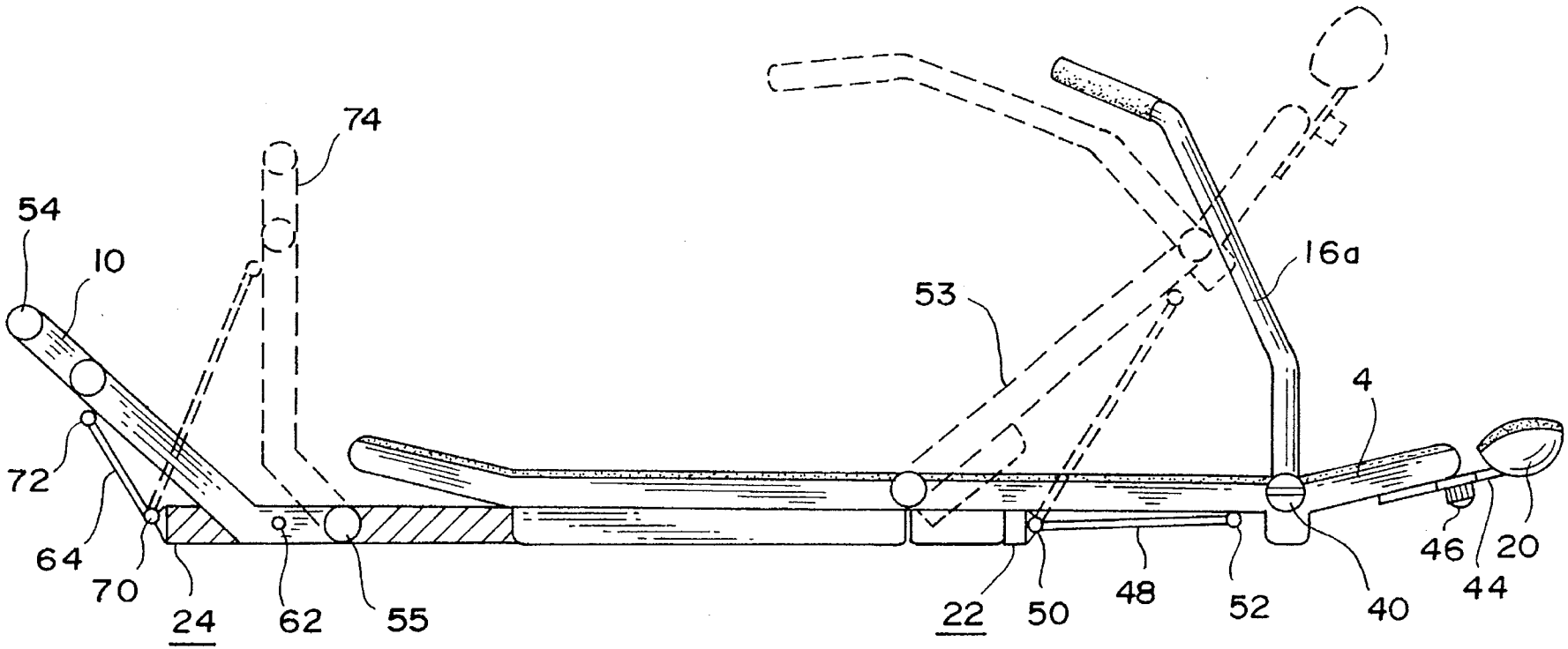
FIG. 3 is a lateral plan view of the FIG. 1 embodiment showing the range of motion of the device.

Referring to FIG. 3, the pivot 55 allows the foot restraint 10 to be drawn up while the user is performing the crunch motion, allowing the knees of the user to be drawn towards the head of the user (as shown by the broken lines 74). The movement of the foot restraint 10 may be disabled by means of a lock device 62 such as a pin or other form of latch or strap which would prevent the movement of the foot restraint 10. An elastic means 64 may be attached between the foot end 24 of the rigid frame 8 and the foot restraint 10 by means of detachable connections 70 and 72. Similar to the operation of the elastic means 48 attached to the upper back support, the elastic means 64 provides resistance to the movement of the foot restraint 10, so that when the user draws the feet up towards the head in the crunch motion, (as shown by broken lines 74) the elastic means 64 provides a pull in the downward direction to increase the resistance to the user. As with the elastic means 48, the elastic means 64 can be exchanged for elastic means of varying resistance rates to alter resistance.

Figure 5:
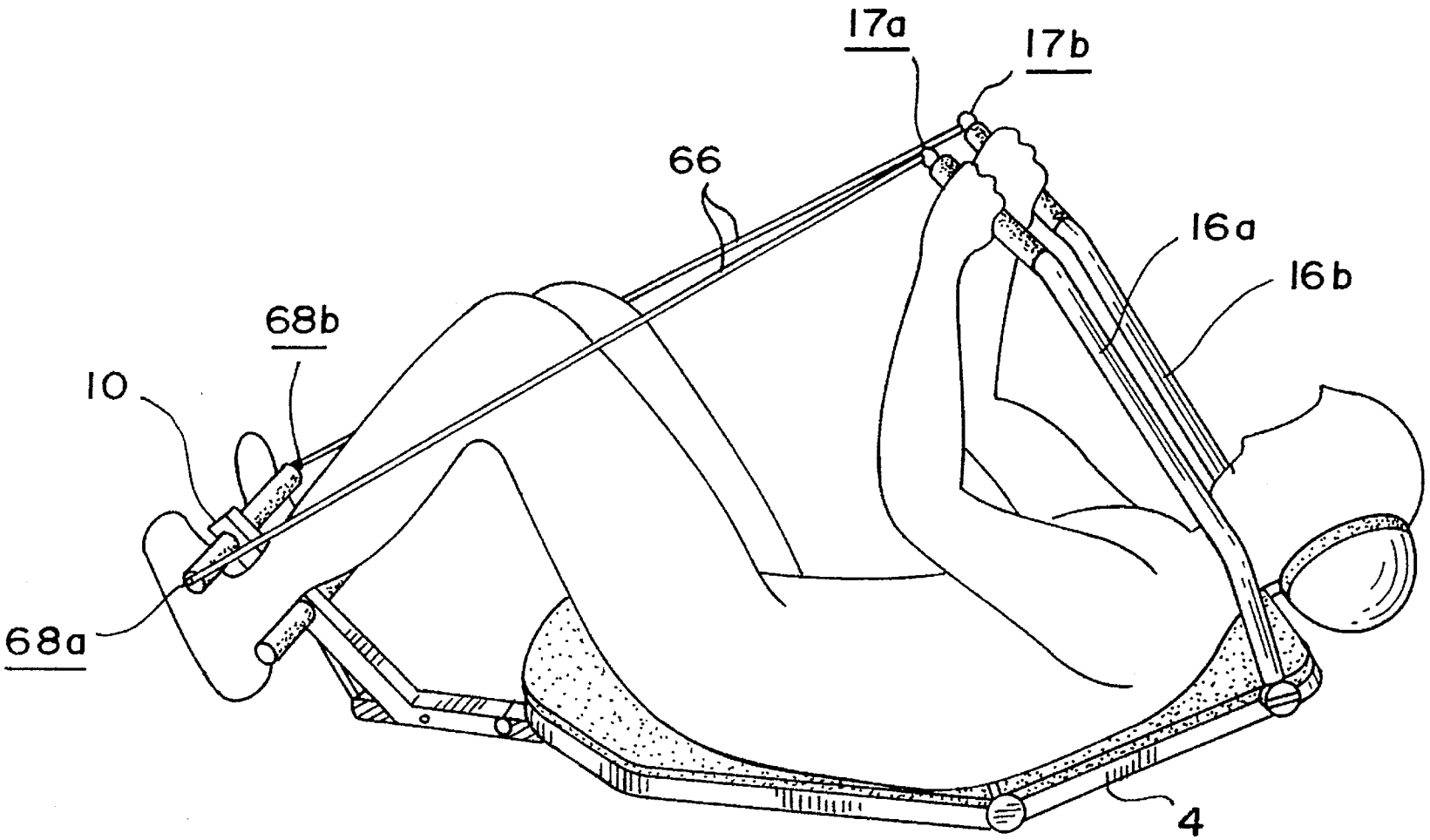
FIG. 5 illustrates the back exercise mode of operational use of the first preferred embodiment wherein a user lays on the device with the feet placed in the foot restraints and with the hands grasping the handles.

Referring to FIG. 5 an elastic means 66 may be attached between the free ends 17*a* and 17*b* of the leverage arms 16*a* and 16*b* and the free ends 68*a* and 68*b* of foot restraint 10. The purpose of this elastic band 66 is to draw the upper back support into the raised position. Thus, as seen in FIG. 5, when the user is positioned on the device 1, he or she is in a "crunched" position and must draw against the resistance of the elastic bands 66 to drive the upper back support 4 down to the ground. By this means the device provides exercise of the back muscles. As with elastic means 48 and 64, elastic means 66 may be exchanged for different means providing different resistances.

Second Preferred Embodiment

Figure 6:
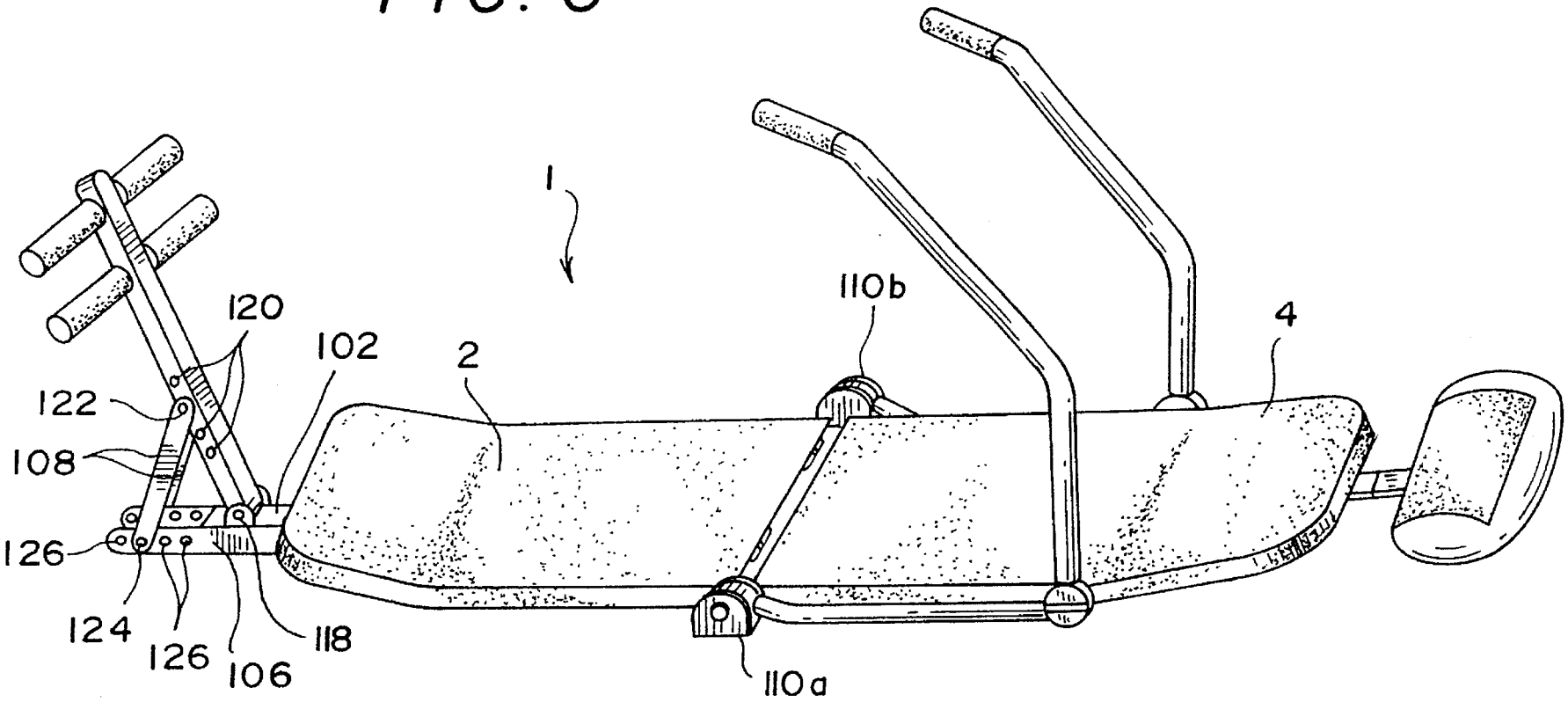
FIG. 6 is a perspective view of a second preferred embodiment.

The second embodiment incorporates most of the features of the first preferred embodiment and will be described with reference FIGS. 6–7. Referring to FIG. 6 an abdominal and back exercise device 1 includes a lower back support 2 and an upper back support 4.

Figure 7:
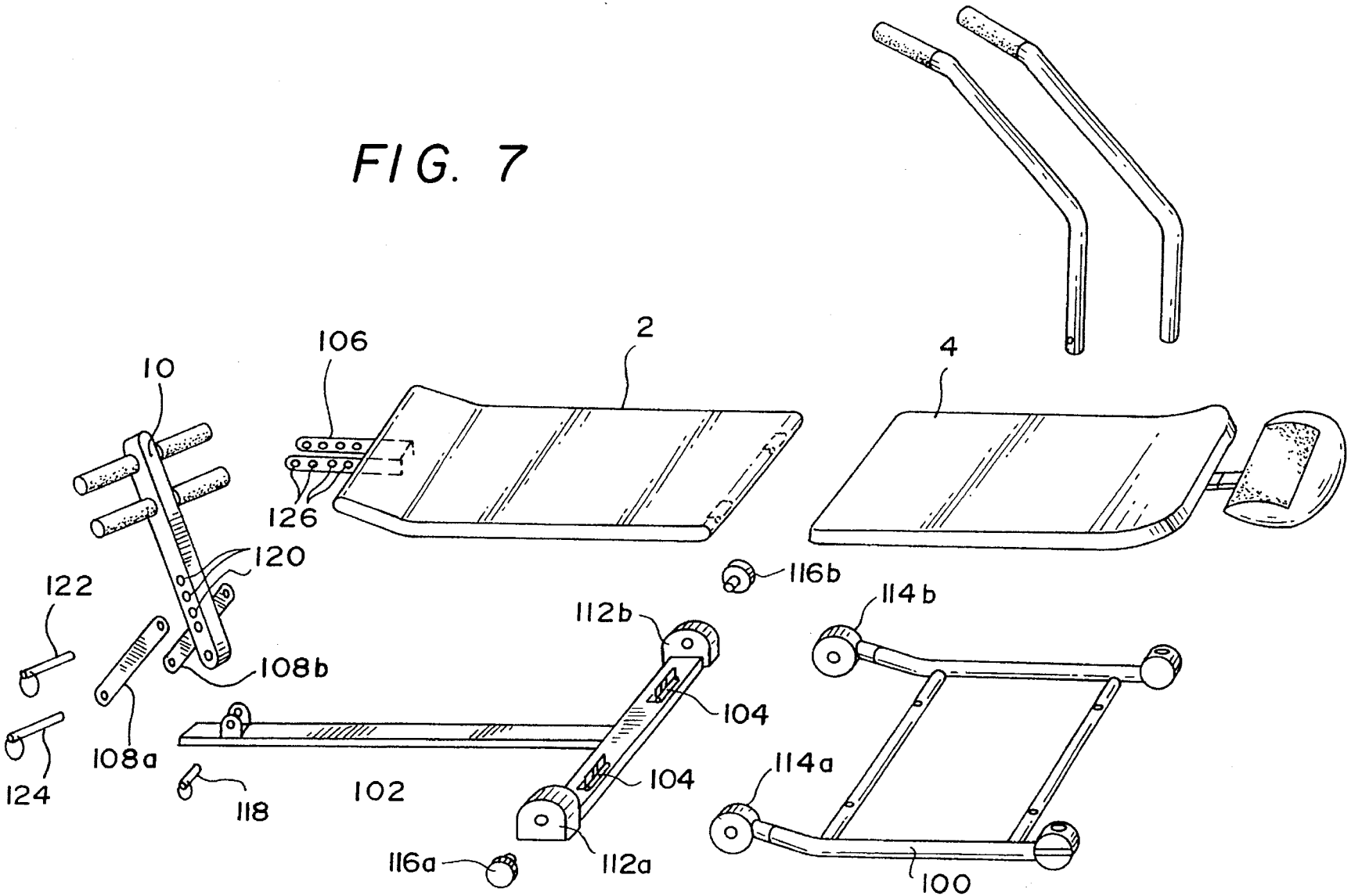
FIG. 7 is an exploded view of the second preferred embodiment.

Referring to FIG. 7, rather than using a unitary frame, the rigid frame 8 can be divided into an upper frame 100 and a lower frame 102. The lower back support 2 is attached to a lower frame 102 by means of a plurality of hinges 104 or other conventional pivotal attachments. Upper back rest 4 is affixed to the upper frame 100. Upper frame 100 is pivotally attached to lower frame 102.

Attached to the free end of the lower back support 2 is a frame extension 106. This frame extension is designed to accommodate attachment, by means of straps 108*a* and 108*b* to the foot restraint 10 in a manner to be discussed in more detail below.

Referring to FIG. 6, back resistance is provided by incorporating isotonic pivots 110*a* and 110*b* into the pivotal attachment joining flames 100 and 102. Ass seen in FIG. 7, the isotonic pivots 110*a* and 110*b* are made up of housings 112*a* and 112*b*; friction units 114*a* and 114*b*; and tensioners 116*a* and 116*b*; or may be other conventional constant friction devices. The isotonic pivots 110*a* and 110*b* provide resistance to the motion of the upper back support 4 and may be adjusted to provide more or less resistance by tightening or loosening tensioners 116*a* and 116*b*.

Referring to FIG. 6, foot restraint 10 is pivotally attached to lower frame 102 by means of a pin 118 or other conventional means of pivotal attachment. Along the length of foot restraint 10 are a plurality of attach points 120 which may consist of holes drilled through the foot restraint 10, latches or other conventional means of adjustable attachment. Pivotally attached to the attach points 120 by means of pin 122 are one or more rigid bands 108 which are in turn pivotally connected by means of pin 124 to frame extension 106. Frame extension 106 is similarly accommodated with numerous attach points 126. The multiple attach points 126 on extension bar 106 and attach points 120 on foot restraint 10 allow the rigid bands 108 to be adjustably attached to foot restraint 10 and extension bar 106 in order to vary the resistance provided by the motion of the user.

A user mounts the device as described in the first embodiment and performs the crunch motion. In the second embodiment, however the resistance to the crunch motion of the upper body is provided by means of isotonic resistance devices 110*a* and 110*b*. The tension on said isotonic attachments 110*a* and 110*b* is adjusted by means of tensioning devices 116*a* and 116*b*. The additional advantage that the isotonic resistance devices 110*a* and 110*b* add to the second embodiment is that resistance is provided both in the upward and downward direction by the same device. Thus the user is able to exercise the abdominal muscles and the back muscles during the same exercise routine, rather than having to engage or disengage elastic means attached to the back of the upper rest and to the leverage arms of the upper rest.

Resistance to the foot portion of the crunch motion is provided by gravity in combination with the user's weight. When the user places his or her feet in the foot restraint 10 and draws the knees towards the head in the crunch motion, the foot restraint 10 rotates around the pivotal attachment 118 and provides an upward pull on the rigid straps 108*a* and 108*b* which in turn draws up on the extension frame 106 and draws the free end of the lower back rest 2 in the upward direction. Because the user's lower body is placed on the lower back rest at the time the weight of the user is transferred through the same linkage to the foot restraint 10, thus creating resistance to the upper motion of the feet.

It should also be noted that the various elements of the first and second preferred embodiments can be selectively interchanged to provide a multitude of equally useful variations. For instance, the mode of applying resistance to the foot restraint in the second preferred embodiment may be combined with the resistance mode for the upper back rest, i.e., elastic means, of the first preferred embodiment. Also, elastic means may be used on the foot and isotonic means on the back or isotonic resistance could be used for the feet.

Although certain preferred embodiments and methods have been disclosed herein, it will be apparent from the foregoing disclosure to those skilled in the art that variations and modifications of such embodiments and methods may be made without departing from the true spirit and scope of the invention. Accordingly, it is intended that the invention shall be limited only to the extent required by the appended claims and the rules and principles of applicable law.

What is claimed is:

1. A device for exercising the abdomen and back of a user, comprising:

a) a rigid frame having a head end and a foot end;

b) a lower back support having a head end and a foot end affixed intermedially to said rigid frame with the head end of said lower back support oriented in the same direction as the head end of said rigid frame;

c) an upper back support having a head end and a foot end further including two leverage arms each comprising a free end and an attached end, wherein said attached ends are affixed to said upper back support and said free ends include handles suitable for grasping, said upper back support further including means for supporting the head and neck of a user;

d) a pivot attaching the foot end of said upper back support to said head end of said lower back support, said pivot positioned such that the location of said pivot coincides with the T10-L1 region of said user's spinal column; and e) a foot restraint having-an attached end and a free end, said attached end being intermedially and pivotally attached proximately to the foot end of said rigid frame.

2. The apparatus of claim 1, further comprising:

means for selectively preventing pivotal motion of said foot restraint.

3. The apparatus of claim 1, further comprising:

an elastic member having a two ends, one end of said elastic member being detachably affixed to the head end of said rigid frame and another end of said elastic member being detachably affixed to said upper back support, for adding resistance to the movement of said upper back support.

4. The apparatus of claim 1, further comprising:

an elastic member having two ends, one end of said elastic member being detachably affixed to the foot end of said rigid frame and another end of said elastic member being detachably affixed to said foot restraint, for adding resistance to the movement of said foot restraint.

5. The apparatus of claim 1, wherein:

the head end of said upper back support is angled from the plane of said upper back support so as to cradle said user; and the foot end of said lower back support is angled from the plane of said lower back support so as to cradle said user.

6. The apparatus of claim 1, further comprising:

an elastic means having two ends, one end of said elastic means being detachably affixed to a free end of said leverage arms, another other end of said elastic means being detachably affixed to said free end of said foot restraint for adding resistance to movement of said upper back support away from said foot restraint.

7. The apparatus of claim 1, wherein:

said pivot includes an isotonic resistance device.

8. The apparatus of claim 1, wherein:

the head end of said lower back support is pivotally attached to said rigid frame;

the foot end of said lower back support is mechanically linked to said foot restraint wherein pivotal motion of said foot restraint draws the foot end of said lower back support in the upward direction.

9. A device for exercising the abdomen and back of a user, comprising:

a) a first rigid frame having a head end and a foot end;

b) a lower back support having a head end and a foot end wherein the head end of said lower back support is pivotally attached to the head end of a said first rigid frame;

c) an upper back support having a head end and a foot end further comprising two leverage arms each comprising a free end and an attached end, wherein said attached ends are affixed to said upper back support and said free ends include handles suitable for grasping, said upper back support further including means for supporting the head and neck of said user wherein said upper back support is affixed to a second rigid frame;

d) wherein second rigid frame is attached to said first rigid frame by means of a pivot such that the foot end of said upper back support is proximate to the head end of said lower back support;

e) wherein said pivot is positioned such that the location of said pivot coincides with the T10-L1 region of a user's spinal column; and f) a foot restraint having an attached end and a free end, said attached end being intermedially and pivotally attached to said foot end of said rigid frame;

g) an extension bar having a head end and a foot end wherein the head end of said extension bar is affixed to the foot end of said lower back support;

h) at least one leverage strap having a first end and a second end;

i) wherein first end of said leverage strap is adjustable and intermedially attached to said foot restraint and second end of said leverage strap is adjustable attached to the foot end of said extension bar.

10. The apparatus of claim 9, further comprising:

means for selectively preventing pivotal motion of said foot restraint.

11. The apparatus of claim 9, wherein:

said pivot includes an isotonic resistance device.

12. The apparatus of claim 9, wherein:

the head end of said upper back support is angled from the plane of said upper back support so as to cradle said user; and the foot end of said lower back support is angled from the plane of said lower back support so as to cradle said user.

* * * * *

UNITED STATES PATENT AND TRADEMARK OFFICE

CERTIFICATE OF CORRECTION

PATENT NO. : 5,545,114

DATED : Aug. 13, 1996

INVENTOR(S) : Ned Gvoich

It is certified that error appears in the above-indentified patent and that said Letters Patent is hereby corrected as shown below:

Column 1, line 15-16, the words "rectus obdominus" should be italicized; line 22-24, the words "erector spinae", "iliocostalis", "longissimus" and "spinalis" should be italicize line 67, the first occurrence of the "." should be deleted.

Column 3, line 2, the "-" should be deleted.

Column 4, line 51, the word "On" should be --one--.

Column 6, line 25, "The" should be --the--; line 56, the word "loser" should be --lower--.

Column 8, line 42, the word "Ass" should be --As--; line 42, the word "flames" should be --frames--.

line 61, the "-" should be deleted.

Claim 3, line 2, the word "a" should be deleted.

Claim 6, line 25, the words "another other" should be --an other--.

Claim 8, line 33, after the word "frame;", insert --and--.

UNITED STATES PATENT AND TRADEMARK OFFICE

CERTIFICATE OF CORRECTION

PATENT NO. : 5,545,114

DATED : Aug. 13, 1996

INVENTOR(S) : Ned Gvoich

It is certified that error appears in the above-indentified patent and that said Letters Patent is hereby corrected as shown below:

Column 10, line 60, (claim 9), delete "and"; column 11, line 2, after the word "end;", insert --and--; column 11, line 5, delete "adjustable" and insert --adjustably--.

Signed and Sealed this

Twenty-fifth Day of March, 1997

*Attest:*

*Attesting Officer*

Bruce Lehman

BRUCE LEHMAN

*Commissioner of Patents and Trademarks*